United States Patent [19]

Greenhow

[11] Patent Number: 4,810,016

[45] Date of Patent: Mar. 7, 1989

[54] LIFTING HOOK

[75] Inventor: David Greenhow, Hamilton, Canada

[73] Assignee: Stelco Inc., Hamilton, Canada

[21] Appl. No.: 661,571

[22] Filed: Oct. 16, 1984

[51] Int. Cl.[4] ..... B66C 1/24

[52] U.S. Cl. ..... 294/67.21

[58] Field of Search ..... 294/67.2–67.5, 294/81.3, 81.5, 81.56, 82.1, 82.16, 86.41, 103.2, 63.1; 267/71

[56] References Cited

U.S. PATENT DOCUMENTS

| | | | |
|---|---|---|---|
| 1,815,290 | 7/1931 | Dedman | 294/82.16 |
| 1,862,081 | 6/1932 | Grant | 294/67.21 |
| 3,291,519 | 12/1966 | Burke | 294/67.2 |

FOREIGN PATENT DOCUMENTS

| | | | |
|---|---|---|---|
| 1462379 | 12/1966 | France | 294/67.2 |
| 454396 | 6/1968 | Switzerland | 294/67.2 |
| 844543 | 7/1981 | U.S.S.R. | 294/67.2 |
| 791430 | 3/1958 | United Kingdom | 294/67.2 |
| 871409 | 6/1961 | United Kingdom | 294/103.2 |
| 1114348 | 5/1968 | United Kingdom | 294/67.21 |

*Primary Examiner*—Johnny D. Cherry
*Attorney, Agent, or Firm*—Sim & McBurney

[57] ABSTRACT

A lifting device includes lower arm and upper arms and an intermediate portion bridging between the arms. A suspension link is pivoted at its bottom to the upper arm, and has a hook latch at its upper end for engagement with a crane hook. A telescopically guided spring exerts a separative force between a location on the link and a further location on the upper arm, which force tends to pivot the link toward the closed end of the hook. The latch has a strike panel which can be contacted by the crane hook in order to bring the latch into engagement position. The intermediate portion of the lifting hook is provided with a horizontally slidable shock absorber casing.

17 Claims, 2 Drawing Sheets

LIFTING HOOK

This invention relates generally to load-handling apparatus, and especially to an apparatus for engaging a load intended to be raised by a crane or hoist.

In particular, this invention has to do with a load-handling lifting device which is provided with means for maintaining a load engaging member thereof in a predetermined position, preferably substantially level or horizontal throughout the loading and unloading operation. While this invention will be described with respect to a "C" hook for handling products like coils of sheet, wire and plate, it will be apparent that it could be equally adapted to other devices, for example pallet lifters.

BACKGROUND OF THE INVENTION

Lifting hooks known generally as "C" hooks are used extensively in the steel industry for handling a wide range of steel products. In addition to handling coils of sheet, wire and plate, they may also be employed with slabs, billets and flat plates.

As a general rule, these "C" hooks must be balanced in such a way that the load-carrying face of the hook is substantially horizontal both when unloaded and when loaded over the full range of loads that the unit is designed to carry. In some designs, the preferred attitude is one in which the load-carrying face is at a slight angle to the horizontal.

Many systems have been used to achieve this consistent attitude, for example counterbalance weights, tension springs, compression springs, and multiple pick-up points.

Counterbalance weights are cumbersome, and may cause extra damage to material being handled due to the added weight and because they protrude past the tip of the hook. Counterbalance weights also reduce the "payload" of a crane, because of the added tare weight. Generally, counterweighted "C" hooks have limited flexibility as to coil sizes they can handle, and limited maneuverability. They are time consuming to operate and have safety limitations.

Most spring-balanced "C" hooks have linkage and tension springs located on the closed end side of the pivot point, resulting in more weight to be counterbalanced, adding additional tare weight to the "C" hook and requiring large springs. Tension springs are generally large and highly stressed and therefore create a safety hazard. Moreover, such designs are generally restricted as to the placing of coils into narrow spaces because of interference due to the linkage jutting out from the upper arm. Due to design and material limitations, such "C" hooks have not achieved acceptable levelling where the payload is variable.

One attempt to achieve this constancy of position for a crane hook is described in U.S. Pat. No. 2,514,307, issued July 4, 1950, to Wilton E. Boyd, and entitled "Crane Hook". In this patent, a cumbersome parallelogram linkage is provided which allows the pick-up point with respect to the "C" hook to shift between two positions, one position for the unloaded hook and the other position for the loaded condition. However, the arrangement shown in this patent is not one which automatically and necessarily reverts to the "unloaded" pick-up point when the load is removed from the "C" hook.

Another approach to the problem is illustrated in Belgian Pat. No. 566,095, issued Apr. 15, 1958 to Societe Ateliers Heuze, Malevez et Simon Reunis. This patent describes a "C" hook having a main suspension link extending upwardly from the upper arm of the hook, together with a complex arrangement of two additional links and a compression helical spring, the result of which is to exert a constant moment on the suspension link tending to move the upper end of the suspension link toward the back of the "C" hook, i.e. to a position in which the top of the suspension link is approximately aligned vertically with the centre of gravity of the unloaded "C" hook. In the loaded condition, the suspension link straightens up to a vertical position, in which position it is approximately aligned with the centre of gravity of the combination of the "C" hook and a typical load supported by the "C" hook. This patent is again very complicated, involving multiple links which add weight to the "C" hook and constitute additional members which may malfunction.

GENERAL DESCRIPTION OF THIS INVENTION

In view of the foregoing, it is an object of an aspect of this invention to provide a lifting hook which tends to remain balanced in both the loaded and unloaded condition, and which accomplishes this with a minimum of linkages and the like.

It is the object of a further aspect of this invention to provide a lifting hook with a main suspension link, the latter being constantly biased toward a position in which its upper end is aligned with the centre of gravity of the unloaded hook, the biasing arrangement being such that the torque or moment tending to rotate the suspension link remains generally constant regardless of its angular position.

It is an object of a further aspect of this invention to provide, at the top of the main suspension link, a pivotal hook latch which may be rotated by impact from a crane hook to a position in which the hook can readily engage the latch.

Finally, it is an object of a further aspect of this invention to provide a lifting hook which incorporates shock-absorbing means adapted to be contacted by a roll of sheet steel and the like, thereby to minimize damage to the payload during loading and unloading.

More particularly, this invention provides a lifting hook comprising a lower arm intended to be maintained substantially horizontal, an upper arm substantially parallel with the lower arm, whereby there is a gap between the arms, an intermediate portion bridging between the two arms, a suspension link having adjacent one end an axis where it is pivoted to the upper arm, means at the other end of the "link by which the same can be lifted, and an assemblage having a first end and a second end, the ends being moveable toward and away from each other, and resilient structure exerting a separative force between said ends, said first end being articulably connected only to a first location on the link spaced from said axis, said second end being articulably connected only to a second location on the upper arm spaced from said axis, said separative force tending to pivot the link toward the intermediate portion."

Additionally, this invention provides a lifting hook comprising a lower arm intended to be maintained substantially horizontal, an upper arm substantially parallel with the lower arm, and intermediate portion bridging between the two arms, a suspension link having adjacent one end an axis where it is pivoted to the upper arm, means at the other end of the link by which the same can be lifted, resilient means tending to pivot the link towards the intermediate portion, said means at the other end of the link being a hook latch pivoted at one end to the link, and having at the other end a transverse spool means engageable by a crane hook.

Additionally, this invention provides a lifting hook comprising a lower arm intended to be maintained substantially horizontal, an upper arm substantially parallel with the lower arm, an intermediate portion bridging between the two arms, a suspension link having adjacent one end an axis where it is pivoted to the upper arm, means at the other end of the link by which the same can be lifted, and a resilient assembly tending to pivot the link toward the intermediate portion, the said means at the other end of the link being a hook latch which includes two spaced-apart walls pivoted to said other end of the link, a pin bridging between said walls and spaced from the location at which the walls are pivoted to the other end of the link, a rotatable spool supported by said pin, and a partition bridging between the walls at a position intermediate the pin and the location at which the walls are pivoted to the other end of the link, the partition being configured so that, when the hook latch is positioned with the pin substantially vertically above the location at which the walls are pivoted to the link, a crane hook can strike the partition by dropping downwardly, thus initiating pivoting movement of the hook latch about the location at which the walls are pivoted to the link, to bring the hook latch to a position in which the crane hook can easily engage said rotatable spool.

Additionally, this invention provides a lifting hook comprising a lower arm intended to be maintained substantially horizontal, an upper arm substantially parallel with the lower arm, whereby there is a gap between the arms, a suspension link having adjacent one end an axis where it is pivoted to the upper arm, means at the other end of the link by which the same can be lifted, resilient means tending to pivot the link toward the intermediate portion, the intermediate portion incorporating a shock-absorbing assembly which includes a casing enclosing a part of the intermediate portion which faces the gap between the two arms, retention means for maintaining the casing in place against the intermediate portion while allowing movement of the casing toward and away from the intermediate portion, and a resilient member between the casing and the intermediate portion, positioned so as to resiliently resist movement of the casing toward the intermediate member.

GENERAL DESCRIPTION OF THE DRAWINGS

One embodiment of this invention is illustrated in the accompanying drawings, in which like numerals denote like parts throughout the several views, and in which.

DETAILED DESCRIPTION OF THE DRAWINGS

Figure 1:
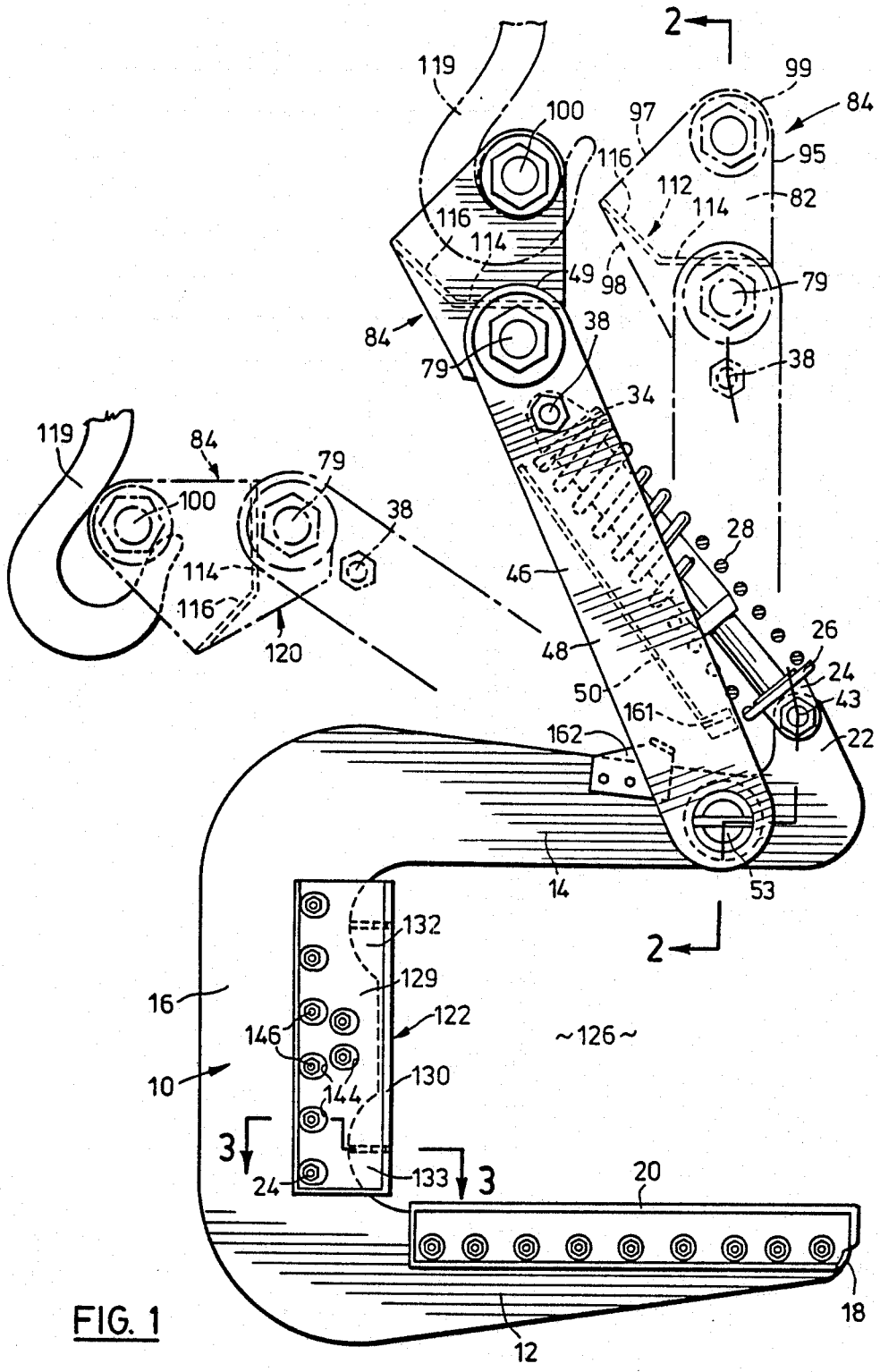
FIG. 1 is a side elevational view of a lifting hook constructed in accordance with this invention, with a portion of the hook being shown in three alternative angular positions.

Attention is first directed to FIG. 1, which shows a lifting hook generally at 10, which includes a lower arm 12, an upper arm 14 substantially parallel with the lower arm 12, at least insofar as the inside surfaces thereof are concerned, and an intermediate portion 16 bridging between the two arms 12 and 14 at their leftward ends.

In accordance with conventional construction, the lower arm 12 tapers toward its free end 18, and is provided with a replaceable saddle 20 for contacting the inside of a roll of steel strip or the like.

At its rightward or forward end, the upper arm 14 has an upwardly extending portion 22 to which is mounted a pivotal bracket 24 which incorporates a plate 26 acting as a bottom guide for a coil spring 28, of which the top end rests against a spacer 30 (see FIG. 2) in the form of a cylindrical sleeve 32 with an annular flange 33, the flange 33 resting against a top guide plate 34 which is secured, as by welding or the like, to two brackets 36 which are journalled on a pin 38.

In a similar manner, the bottom guide plate 26 is welded or otherwise secured to two brackets 41 which are secured to a transverse pin 43 which is journalled through the portion 22.

Referring back to FIG. 1, a suspension link 46 consists of two spaced-apart members 48, through which the pin 38 extends adjacent the upper ends 49 of the members 48. Shown in broken lines in FIG. 1 is an oblique stiffener plate 50 which is welded to both members 48.

Each member 48 is welded or otherwise secured to a reinforcement disk 51 at its lower end, and both the member 48 and the associated disk 51 are bored to receive a pin 53 which is threaded at the left end to receive a nut 54, and at the rightward end to receive a nut 56.

Figure 2:
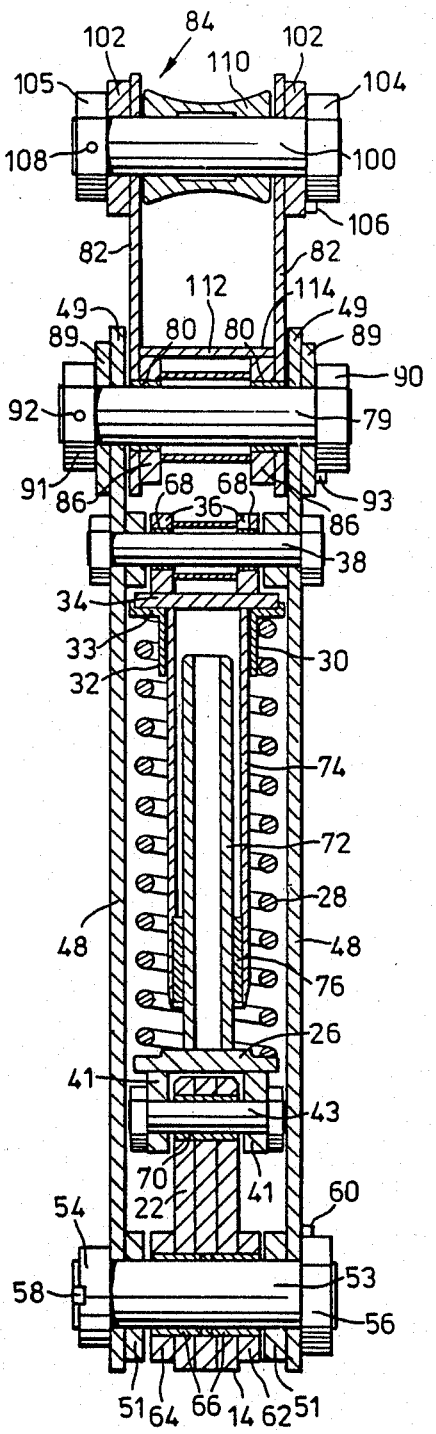
FIG. 2 is a sectional view taken at the line 2—2 in FIG. 1.

After assembly of the nuts 54 and 56 to the pin 53, they are secured in place by fitting a bar 58 in a diametral slot at the left end of the pin 53 and tack-welding the bar to the nut 54, and by welding a bar 60 to the member 48 shown on the right in FIG. 2 in a position so as to resist rotation of the nut 56. At the same time, the nut 56 and pin 53 are tack-welded together.

The pin 53 is journalled in the upper arm 14, which also is provided with welded reinforcing disks 62 and 64. Standard sleeve bearings 66 are provided around the pin 53, and bearings 68 are provided around the pin 38. A sleeve bearing 70 is provided around the pin 43.

The compression coil spring 28 is provided with a telescoping alignment assembly incorporating two cylindrical members. As seen in FIG. 2, a first cylindrical member 72 extends upwardly from the plate 26, and a second cylindrical member 74 extends downwardly from the plate 34 in surrounding relationship with the cylindrical member 72. At the inside bottom of the outer cylindrical member 74 there is provided a sleeve bearing 76 to allow the two cylindrical members to slide with respect to each other.

At the top end of the members 48 constituting the suspension link 46 there is provided a further pin 79 journalled in two sleeve bearings 80 contained within bores passing through two spaced-apart walls 82 of a hook latch 84, the walls 82 being reinforced at their lower ends with reinforcement disks 86. The pin 79 passes through bores in the members 48, at locations where the members 48 are reinforced by reinforcing disks 89 which are welded thereto.

The pin 79 is threaded at either end to receive hex nuts 90 and 91, the hex nut 91 being secured in position with respect to the pin 79 by the passage of a diametral rod 92, which is peened at assembly. The other hex nut 90 is maintained in position by a keeper bar 93 welded to the rightward reinforcement disk 89 seen in FIG. 2. At the same time, the nut 90 and the pin 79 are tack-welded together.

The walls 82 have the shape shown in FIG. 1 in elevation. More specifically, the walls 82 define a forward edge 95, and two rearward edges 97 and 98 which meet at an obtuse angle. The junction between the edges 95 and 97 is rounded at 99, and within that rounded corner is located a pin 100 which passes through a bore extending through each wall 82 and an associated reinforcement disk 102 welded thereto. The pin 100 is threaded to receive hex nuts 104 and 105, the hex nuts being locked into position by a keeper bar 106 and a peened diametral rod 108, respectively, in the same manner as has been described for the pin 79. Also, the nut 104 is tack-welded to the pin 100 at the time of assembly.

The pins 38 and 43 are likewise threaded to engage hex nuts on either end. In the same manner as the other pins already discussed, the hex nuts for pins 38 and 43 have keeper bars and diametral rods. These components are shown in FIG. 2, but have not been numbered in order to avoid cluttering the drawing.

The pin 100 passes through a steel spool 110 contained between the two walls 82.

Also provided between the walls 82 is a partition 112 which includes two portions 114 and 116 which are angled with respect to each other, the portion 116 projecting leftwardly from a plane containing the axes of the pins 79 and 100, in such a manner that a crane hook 119 can be lowered by an operator from above into contact with the portion 116. This will cause the latch to pivot in a counterclockwise direction as seen in FIG. 1, to take up the position shown at 120 in FIG. 1. In this position, the pin 100 lies leftwardly from the pin 79, and can readily be engaged by the crane hook 119.

Welded between the two members 48 constituting the suspension link 46 is a composite striker bar 161 which is adapted to abut against an abutment bracket 162 secured to the top of the upper arm 14. Contact between these two determines the furthest leftward (furthest counterclockwise) position of the suspension link 46 with respect to the upper arm 14. This furthest left position has been drawn in FIG. 1, and is the position assumed by the link 46 when at rest and disengaged from the crane hook 119. The striker bar 161 also restricts clockwise movement of the link 46 to the vertical position shown at upper right in FIG. 1, due to its contact with the upwardly extending portion 22.

The intermediate illustrated position of the link 46 is that assumed when the lifting hook 10 is unloaded. In this position, the centre of gravity of the lifting hook 10 is substantially vertically aligned with the pin 79. The furthest rightward position of the link 46 is that assumed when the lifting hook is under load. In this position, the centre of gravity of the combined load and hook 10 is generally vertically aligned with the pin 79.

Figure 3:
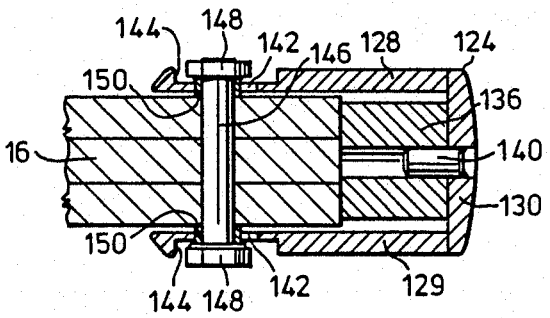
FIG. 3 is a sectional view taken at the line 3—3 in FIG. 1.

Attention is now directed to FIGS. 1 and 3, for a description of the shock-absorbing assembly attached to the intermediate portion 16.

The shock-absorbing assembly is shown generally at 122, and includes a casing 124 which encloses a part of the intermediate portion 16, namely the part which faces the gap 126 between the two arms 12 and 14.

More particularly, the casing includes two flanking walls 128 and 129 which are welded or otherwise secured to an abutment wall 130 which bridges between the flanking walls 128 and 129.

The intermediate portion 16 of the lifting hook 10 is shaped to define two pockets 132, 133, as can be seen in FIG. 1. Within these pockets, the casing 124 contains two resilient members, of which the lower one is shown at 136 in FIG. 3. Each resilient member 136 is retained in place with respect to the abutment wall 130 by a pin 140 which is welded with respect to the abutment wall 130 and projects inwardly therefrom.

The flanking walls 128 and 129 are retained with respect to the intermediate portion 16 of the lifting hook 10 in such a way as to allow horizontal reciprocating movement of the casing 124 toward and away from the intermediate portion 16. More specifically, each of the flanking walls 128, 129 has a plurality of elongated apertures 142 (see FIG. 3), each set into a recess 144. A plurality of studs 146 pass through suitable bores in the intermediate portion 16, the studs being threaded at their ends to receive hex jam nuts 148. Spacers 150 are provided (see FIG. 3) so as to maintain the flanking walls 128 and 129 out of contact with the intermediate portion 16.

Due to the elongated nature of the apertures 142, it will be appreciated that the casing 124 is permitted a limited reciprocating horizontal movement with respect to the intermediate portion 16, in order to allow for impact by a payload such as a coil of metal strip. This minimizes damage to the edges of the strip during any such impact.

It will be noted, particularly by looking at FIG. 1, that the positioning of the spring 28 and its associated telescoping structure with respect to the link 46 allows a relatively constant turning moment or torque to be exerted on the link 46, regardless of its position. To explain this in greater detail, it will be noted that the pin 43 is located above and to the right of the pin 53. Secondly, when the link 46 is in its upright, "loaded" position, as shown at the furthest right in FIG. 1, the pin 43 is spaced at a smaller perpendicular distance from a line joining the pins 53 and 79 than it is when the link 46 is at its leftward sloping, "unloaded" position. Thirdly, the spring 28 is more stressed, i.e. exerts a greater separative force between the pins 43 and 38, when the link 46 is in its upright position, than is the case when the link 46 is in its leftward sloping position. Thus, it will be seen that when the spring force increases, the "moment arm" about which that force is exerted on the link 46 decreases. Similarly, when the spring force decreases, the moment arm increases. In a general way, this will maintain the torque itself relatively constant. This relatively constant torque is essentially to balance the lifting hook itself, and not to "off-balance" the load. This is of advantage in that the torque does not tend to "dump" wide, light loads.

A further advantage of the structure described above relates to the fact that the total weight created by the spring 28, the telescoping cylindrical members 72 and 74, and the related portions, tends to help the balancing effect. In other words, all of these members are on the "open end" side of the pivot point 53, and therefore tend to help counterbalance the considerably greater weight constituted by the intermediate portion 16.

Additionally the suspension and counter-balancing apparatus is located so as not to protrude beyond the end of the upper arm 14, thus not limiting the maneuverability of the lifting hook 10.

Finally, this system requires a minimum sized spring 28, and this again reduces the tare weight.

While one embodiment of this invention has been illustrated in the appended drawings and described hereinabove, it will be evident to those skilled in the art that changes and modifications may be made therein without departing from the essence of this invention, as set forth in the appended claims.

The embodiments of the invention in which an exclusive property or privilege is claimed are defined as follows:

1. A lifting device comprising:

a lower arm intended to be maintained substantially horizontal, an upper arm substantially aligned with the lower arm, whereby there is a gap between the arms, an intermediate portion bridging between the two arms, a suspension link having adjacent one end an axis where it is pivoted to the upper arm, means at the other end of the link by which the same can be lifted, and an assemblage having a first end and a second end, the ends being moveable toward and away from each other, and resilient structure exerting a separative force between said ends, said first end being articulably connected only to a first location on the link spaced from said axis, said second end being articulably connected only to a second location on the upper arm spaced from said axis, said separative force tending to pivot the link toward the intermediate portion.

2. The device claimed in claim 1, in which said resilient structure includes a telescoping guide and a compression coil spring surrounding the guide.

3. The device claimed in claim 1, in which the said axis is located on the upper arm substantially where a vertical line through the center of gravity of the hook when loaded would pass.

4. The device claimed in claim 3, in which the said axis is located between the second location and the said intermediate portion.

5. The device claimed in claim 4, in which the said second location is raised vertically above the said axis when the upper arm is horizontal, the assemblage exerting a first force on the link when the latter extends vertically upward from the axis with the upper arm horizontal, and exerting a second force on the link when the latter has been pivoted away from the vertically extending position toward the intermediate portion, the second force being smaller than the first force.

6. The device claimed in claim 5, in which the perpendicular distance between said second location and the link is smaller when the link extends vertically upward from the upper arm than it is when the link has been pivoted toward the intermediate portion.

7. The device claimed in claim 6, in which said resilient structure includes a telescoping guide and a compression coil spring surrounding the guide.

8. The device claimed in claim 4, in which said means at the other end of the link is a hook latch comprising:

two spaced-apart walls pivoted at a third location to said other end of the link, a pin bridging between said walls and spaced from the third location, a rotatable spool supported by said pin, a partition bridging between the walls at a position intermediate between said third location and said pin, the partition being configured so that, when the hook latch is positioned with the pin substantially vertically above the third location a crane hook can strike the partition by dropping downwardly, thus initiating pivoting movement of the hook latch about said third location to bring the hook latch to a position in which the crane hook can easily engage said rotatable spool.

9. The device claimed in claim 8, in which the intermediate portion incorporates a shock-absorbing assembly comprising:

a casing enclosing a part of the intermediate portion which faces the gap between the two arms, retention means for maintaining the casing in place against the intermediate portion while allowing movement of the casing toward and away from the intermediate portion, and a resilient member between the casing and the intermediate portion, positioned so as to resiliently resist movement of the casing toward the intermediate member.

10. The device claimed in claim 4, in which the intermediate portion incorporates a shock-absorbing assembly comprising:

a casing enclosing a part of the intermediate portion which faces the gap between the two arms, retention means for maintaining the casing in place against the intermediate portion while allowing movement of the casing toward and away from the intermediate portion, and a resilient member between the casing and the intermediate position, positioned so as to resiliently resist movement of the casing toward the intermediate member.

11. The device claimed in claim 1, in which said means at the other end of the link includes a hook latch pivoted at one end to the link and having at the other end a transverse spool engageable by a crane hook.

12. The device claimed in claim 1, in which said means at the other end of the link is a hook latch comprising:

two spaced-apart walls pivoted at a third location to said other end of the link, a pin bridging between said walls and spaced from the third location, a rotatable spool supported by said pin, a partition bridging between the walls at a position intermediate between said third location and said pin, the partition being configured so that, when the hook latch is positioned with the pin substantially vertically above the third location, a crane hook can strike the partition by dropping downwardly, thus initiating pivoting movement of the hook latch about said third location to bring the hook latch to a position in which the crane hook can easily engage said rotatable spool.

13. The device claimed in claim 1, in which the intermediate portion incorporates a shock-absorbing assembly comprising:

a casing enclosing a part of the intermediate portion which faces the gap between the two arms, retention means for maintaining the casing in place against the intermediate portion while allowing movement of the casing toward and away from the intermediate portion, and a resilient member between the casing and the intermediate portion, positioned so as to resiliently resist movement of the casing toward the intermediate member.

14. The device claimed in claim 13, in which the casing includes two flanking walls lying to either side of the intermediate portion, and an abutment wall bridging between the flanking walls, said resilient member being enclosed by said walls, the flanking walls having elongated apertures for receiving pin members passing through the intermediate portion, thus constituting said retention means.

15. A lifting device comprising:

a lower arm intended to be maintained substantially horizontal, an upper arm substantially parallel with the lower arm, an intermediate portion bridging between the two arms, a suspension link having adjacent one end an axis where it is pivoted to the upper arm, means at the other end of the link by which the same can be lifted, and a resilient assembly tending to pivot the link toward the intermediate portion, the said means at the other end of the link being a hook latch which includes two spaced-apart walls pivoted to said other end of the link, a pin bridging between said walls and spaced from the location at which the walls are pivoted to the other end of the link, a rotatable spool supported by said pin, and a partition bridging between the walls at a position intermediate the pin and the location at which the walls are pivoted to the other end of the link, the partition being configured so that, when the hook latch is positioned with the pin substantially vertically above the location at which the walls are pivoted to the link, a crane hook can strike the partition by dropping downwardly, thus initiating pivoting movement of the hook latch about the location at which the walls are pivoted to the link, to bring the hook latch to a position in which the crane hook can easily engage said rotatable spool.

16. A lifting device comprising:

a lower arm intended to be maintained substantially horizontal, an upper arm substantially parallel with the lower arm, whereby there is a gap between the arms, an intermediate portion bridging between the two arms, a suspension link having adjacent one end an axis where it is pivoted to the upper arm, means at the other end of the link by which the same can be lifted, resilient means tending to pivot the link toward the intermediate portion, the intermediate portion incorporating a shock-absorbing assembly which includes a casing enclosing a part of the intermediate portion which faces the gap between the two arms, retention means for maintaining the casing in place against the intermediate portion while allowing movement of the casing toward and away from the intermediate portion, and a resilient member between the casing and the intermediate portion, positioned so as to resiliently resist movement of the casing toward the intermediate member.

17. The device claimed in claim 16, in which the casing includes two flanking walls lying to either side of the intermediate portion, and an abutment wall bridging between the flanking walls, said resilient member being enclosed by said walls, the flanking walls having elongated apertures for receiving pin members passing through the intermediate portion, thus constituting said retention means.

* * * * *